US005509179A

United States Patent [19]

Mondini et al.

[11] Patent Number: 5,509,179

[45] Date of Patent: Apr. 23, 1996

[54] AUTOLEVELLER DRAW FRAME HAVING PROCESS FEED BACK CONTROL SYSTEM

[76] Inventors: Giancarlo Mondini, Theodor Reuter Weg 6, Winterthur, CH-8400; Urs Meyer, Hohfurristrasse 1, Niederglatt, CH-8172; Robert Moser, Wingertlistrasse 41, Winterthur, CH-8405; Jurg Bischofberger, Carl Spittelerstrasse 7, Raterschen, CH-8352; Urs Keller, Heimensteinstrasse 21, Seuzach, CH-8472; Erich Jornot, Leberenstrasse 25, Seuzach, CH-8472, all of Switzerland

[21] Appl. No.: 327,782

[22] Filed: Oct. 20, 1994

Related U.S. Application Data

[62] Division of Ser. No. 855,015, Apr. 27, 1992, abandoned.

[30] Foreign Application Priority Data

Jun. 25, 1990 [CH] Switzerland ..... 02112/90

[51] Int. Cl.[6] ..... D01G 21/00; D01H 5/32

[52] U.S. Cl. ..... 19/239; 19/65 A; 19/236

[58] Field of Search ..... 19/65 A, 239, 19/240, 241, 236; 364/470

[56] References Cited

U.S. PATENT DOCUMENTS

| | | | |
|---|---|---|---|
| 4,267,620 | 5/1981 | Allen, Jr. | 19/239 |
| 4,271,565 | 6/1981 | Grunder . | |
| 4,369,550 | 1/1983 | Meile | 19/240 |
| 4,512,061 | 4/1985 | Hartmannsgruber et al. | 19/239 |
| 4,703,431 | 10/1987 | Sako et al. . | |
| 4,758,968 | 4/1988 | Lord . | |
| 4,812,993 | 3/1989 | Konig et al. . | |
| 4,876,769 | 10/1989 | Schlepfer et al. . | |
| 4,953,265 | 9/1990 | Scheinhutte . | |
| 4,974,296 | 12/1990 | Vidler | 19/239 |
| 5,007,136 | 4/1991 | Artzt et al. | 19/65 A |
| 5,014,395 | 5/1991 | Staheli et al. . | |
| 5,018,248 | 5/1991 | Haworth et al. . | |
| 5,134,755 | 4/1992 | Jornot | 19/239 |
| 5,161,111 | 11/1992 | Oehler et al. . | |
| 5,230,125 | 7/1993 | Clement et al. | 19/236 X |

FOREIGN PATENT DOCUMENTS

| | | |
|---|---|---|
| 0264329 | 8/1968 | Australia . |
| 0303023 | 2/1989 | European Pat. Off. . |
| 0340756 | 11/1989 | European Pat. Off. . |
| 0362538 | 4/1990 | European Pat. Off. . |
| 0365901 | 5/1990 | European Pat. Off. . |
| 0376002 | 7/1990 | European Pat. Off. . |
| 0399315 | 11/1990 | European Pat. Off. . |
| 0402940 | 12/1990 | European Pat. Off. . |
| 0409772 | 1/1991 | European Pat. Off. . |

(List continued on next page.)

OTHER PUBLICATIONS

Melliand Textile Reports, vol. 7, 1985, pp. 499–503; Dipl.–Ing. Uwe Behrens, "Computer–Supported—Transportation System in Textile Production".

Manual of Textile Technology: The Textile Institute, specifically p. 24; S. L. Anderson, "Textile fibers: Testing and Quality Control".

Manual of Textile Technology: The Textile Institute, vol. 1, pp. 2–20; W. Klein, "The Technology of Short–Staple Spinning".

(List continued on next page.)

*Primary Examiner*—John J. Calvert

*Attorney, Agent, or Firm*—Sandler, Greenblum & Bernstein

[57] ABSTRACT

An apparatus for controlling a fiber processing plant including a series of processing stages in order to supply fibrous material as a product with predetermined qualities, whereby the qualities of the product can be influenced by suitable, selectively adjustable treatment of fibrous material during its passage through the plant and whereby in at least one of the intermediate stages of the plant an ascertainable quality of the product of this stage is determined. In this intermediate stage a signal is obtained which is equivalent to the ascertainable quality and which is used for controlling the previous stages.

7 Claims, 8 Drawing Sheets

U.S. PATENT DOCUMENTS

| | | |
|---|---|---|
| 0410429 | 1/1991 | European Pat. Off. . |
| 0412448 | 2/1991 | European Pat. Off. . |
| 0411379 | 2/1991 | European Pat. Off. . |
| 2734564 | 2/1979 | Germany . |
| 3237371 | 9/1983 | Germany . |
| 3237864 | 4/1984 | Germany . |
| 3906508 | 9/1989 | Germany . |
| 3924779 | 1/1991 | Germany . |
| 0286376 | 1/1991 | Germany . |
| 4024307 | 2/1992 | Germany . |
| 61-277038 | 12/1986 | Japan . |
| 4754/88 | of 1988 | Switzerland . |
| 189/91 | 1/1991 | Switzerland . |
| 1025/91 | 4/1991 | Switzerland . |
| 1397567 | 5/1988 | U.S.S.R. . |
| 2081758 | 2/1982 | United Kingdom . |
| 9116481 | 10/1991 | WIPO . |

OTHER PUBLICATIONS

Drawing Combing and Roving, vol. III, pp. 84–137; Zoltan Szaloki published by the Institute of Textile Technology, Charlottesville, Virginia.

Melliand Textile Reports, vol. 5, 1990, pp. 330–332; Dr. Giancarlo Mondini," The Combing Room as the Decisive Profitability Factor in Short–Staple Spinning".

Manual of Textile Technology: The Textile Institute, vol. 3, pp. 1–39; W. Klein, "A Practical Guide to Combing and Drawing".

Operating Manual: Zellweger Company, Uster AG, pp. 129–149; "Evenness Test".

Lectures of Messrs. Dr. U. Meyer and H. Howald on the occasion of the VDI annual meeting in Aachen on Jan. 30 and 31, 1991.

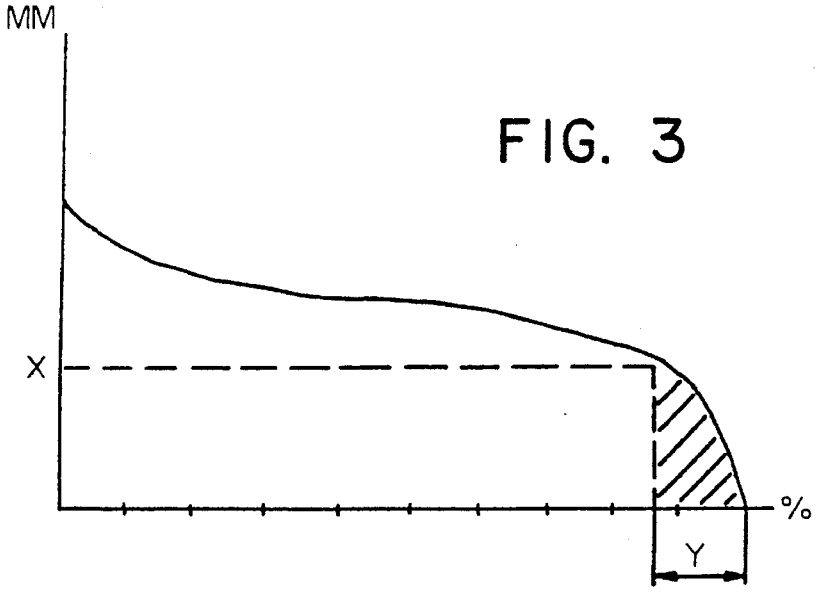
FIG. 3
FIG. 4
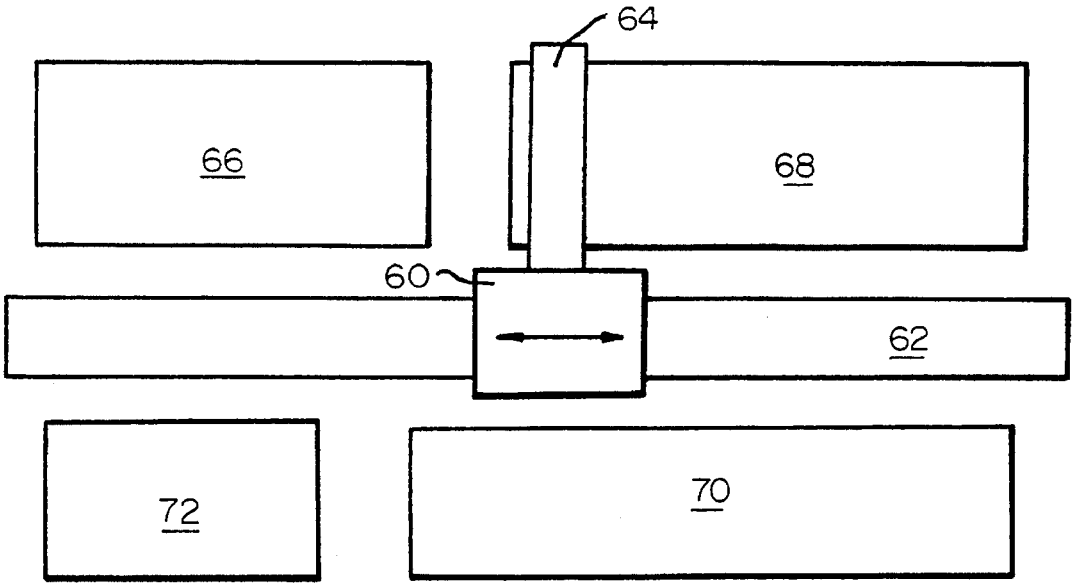
FIG. 5
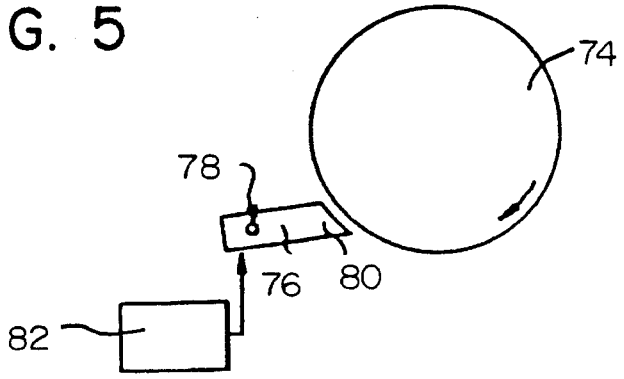

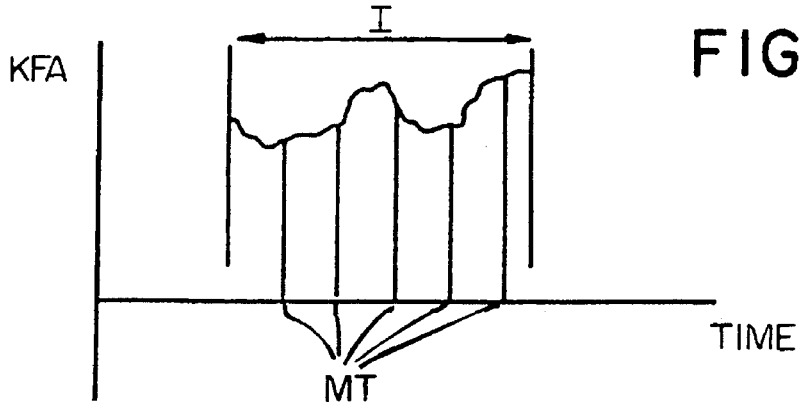
FIG. 9A
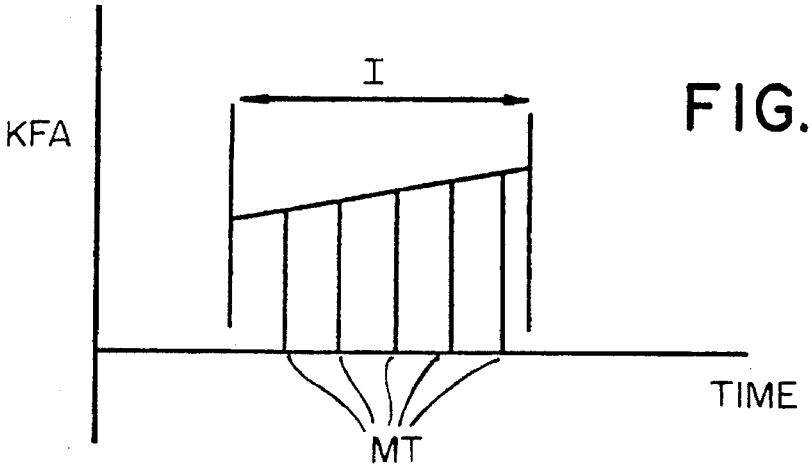
FIG. 9B
FIG. 10
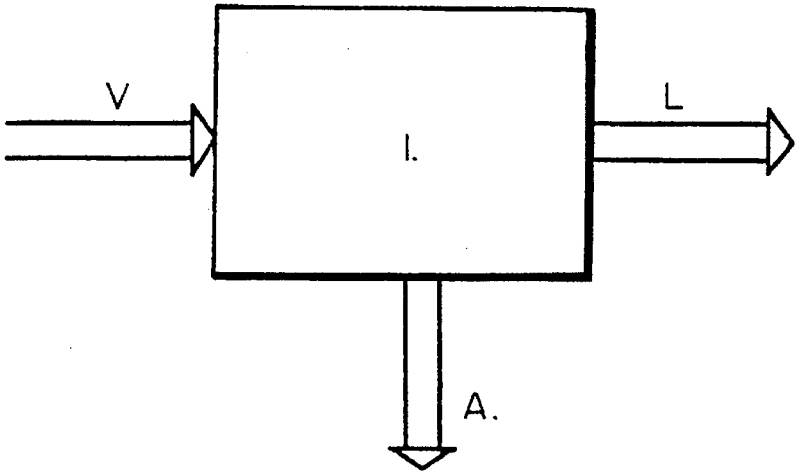

AUTOLEVELLER DRAW FRAME HAVING PROCESS FEED BACK CONTROL SYSTEM

This application is a division of application Ser. No. 07/855,015, filed on Apr. 27, 1992, which is a continuation of international application No. PCT/CH91/00140, filed on Jun. 25, 1991.

The invention relates to a method for gaining information and generating signals which is particularly suitable for use in a process control system for a spinning mill. The information or the signals thus gained may be used for controlling or regulating purposes or for operational support.

DESCRIPTION OF BACKGROUND AND RELEVANT INFORMATION

A present conventional spinning plant uses fibrous material in the form of bales as the feed material and converts it into yarn over a series of various processing stages. The yarn must fulfill predefined quality specifications. The ability to control the conversion automatically is one object of the invention, as will be discussed below. For various reasons this is a very difficult task, of which only some categories of such shall be mentioned below:

There are the various requirements that the product of the spinning mill (yarn) has to fulfill by its further processing to a final product (e.g. a product made from woven or knitted fabric).

There is the number of processing stages that have a decisive influence on the conversion of the fibrous material to yarn.

There are the various technological factors that have an impact on each processing stage.

It has been proposed to divide the spinning line into "areas" that are each attributed to an own process control computer, whereby various divisions have been proposed by various persons (see also DE-A-39 24 779, Maschinenfabrik Rieter AG, and DE-A-39 06 508, Murata Kikai K. K.).

It has also been proposed to combine by way of control the first processing stages of the spinning line (the blow room and the carding room), i.e. DE-A-32 37 864, EP-A-0 303 023 and U.S. Pat. No. 4 876 769. Proposals have been submitted which allow controlling both the composition of the material to be processed as well as the processing of said material in the first stages of the spinning line, i.e. EP-A-0 362 538; EP-A-0 402 940, EP-A-0 399 315 and EP 90 810454.0.

It is still common practice to monitor the evenness of the product of the card (card silver) and to control the card in such a manner that either the best possible or predetermined evenness of the card sliver is achieved (see, for example, U.S. Pat. No. 4,271,565).

Data transmission systems are also presently used for connecting the spinning line or its controls with an overlaid process control system. For further details refer to the Swiss patent application No. 189/91 of Jan. 23, 1991 (lectures of Messrs. Dr. U. Meyer and H. Howald on the occasion of the VDI annual meeting in Aachen on Jan. 30 and 31, 1991). The first plans for realizing such a process control system in the Spinning mill rather aimed at an essential improvement in operational support than "fully automatic operation"; see PCT patent application No. PCT/CH 91/0097 of Apr. 23, 1991.

The efforts of various firms which are active in this field of technology mainly aim at connecting the above-mentioned first stages and the last stages (end spinning and roving yarn stages) of the spinning line and the subsequent bobbin winding machine (for ring-spun yarn) with the process control system; see. EP-A 0 365 901. However, between these first and last stages there are still some other processing stages that fulfill important tasks in processing the material and that are able to supply important information to the process control system.

SUMMARY OF THE INVENTION

It is the object of the present invention to reduce the complexity of the overall problem of fully automating a spinning line by extracting identifiable parts of problems.

The invention provides a method for controlling a fibre processing plant comprising a series of processing stages in order to supply fibrous material as a product with predetermined qualities, whereby the qualities of said product can be influenced by suitable, selectively adjustable treatment of fibrous material during its passage through the plant and whereby in at least one of the intermediate stages of said plant an ascertainable quality of said product of this stage is determined, thus allowing the respective quality of the product to be decisively influenced or determined.

A particular feature of the method is that in the mentioned intermediate stage a signal is obtained which constitutes a measure for the ascertainable quality of the intermediate product mentioned above.

This signal can be used for controlling at least one processing stage which the fibre has to pass before reaching the mentioned intermediate stage and which can have an influence on the mentioned ascertainable quality. The signal can, however, also be displayed in a suitable manner and thus used for operational support i.e., assistance to the operating staff.

In a particularly preferable example of this method the intermediate stage is a combing plant and the ascertainable quality is the proportion of short fibres in the material to be processed. The previous stages are the blow room, the opening room and the carding room of the plant. The signal obtained in the carding room can be used for controlling a mixing process and/or for controlling the intensity of the opening and cleaning of the fibrous material. If the idle time of the intermediate processing does not allow a control based on the signal gained in the carding room, the signal can be suitably processed for operational support, whereby, for example, an alarm is provided with respect to the behaviour of the previous stages or with respect to the supplied material.

The invention also relates to a fibre processing plant which includes a means for obtained the mentioned signal and a controlling means for the previous stage which can influence the ascertainable quality. This may also include automatic intervention on the part of the control unit. The plant may, however, also comprise a display means which serves as a decision support tool for an intervention to be carried out by the operating personnel.

The condition displayed by the mentioned signal is preferably compared with a predefined desired condition (e.g. in a computer) in order to establish any deviations from the desired condition. When such a deviation from the desired condition is detected, a control process is preferably carried out at first in order to determine whether this deviation was not caused by the intermediate stage (e.g. the carding room) itself. In the latter case no control signal is sent to the controlling means for the previous stages. The error condition of the mentioned intermediate stage is displayed or removed by suitable measures. Only when an error condition of the intermediate stage is no longer detected should a control signal be sent to the previous stage or to its control unit.

The above-mentioned comments on the invention mainly deal with the composition of the material, in particular the proportion of short fibres. As is explained below by reference to the Figures, the proportion of short fibres of the yarn is determined by the combing room. Further features of intermediate products of a spinning mill are of importance for the final results.

An important quality feature of the said fibre product is its so-called "evenness" which can be defined by the fibre mass per length unit of the product.

In a well-managed spinning plant of the present conventional type the evenness of the final product (the yarn) is substantially determined by the end spinning process (flyer and ring spinning or rotor spinning or any other new spinning process). The preparatory stages contribute very little to the final result (concerning unevenness).

However, one cannot simply draw the conclusion that the control of evenness in the preparatory stages can be neglected. Serious mistakes can also occur in the preparatory stage of a well-organized spinning plant and can have a decisive influence on the final result. In addition, the competitiveness of a spinning plant depends on very small differences in their product to those in the products of their competitors. Therefore it is necessary to make even the smallest possible contributions for reducing unevenness. Note must be taken of the fact that in the end spinning process (at least in presently available spinning machines) it is not possible to rectify flaws in the evenness of the fed material. Efforts in the field of end spinning methods aim at limiting the unevenness caused by the end spinning process itself.

For the reasons mentioned above, measures are mostly taken in the preparatory stages either to improve the evenness of the intermediate product of each processing stage or at least to keep it under control. As the last measure before the end spinning the fibre structures are often subjected to a draft in an autoleveller draw frame in order to improve the evenness of the structure before it is fed to the end spinning process.

The above-mentioned statements make it quite clear that an autoleveller draw frame is not able to determine the evenness of the final product of the whole spinning line (the yarn), because this result is determined by the end spinning process itself. However, such an autoleveller draw frame is able to determine the contribution of the preparatory stages to the unevenness of the final product and it is the task of such a draw frame to reduce this contribution to a minimum. If the autoleveller draw frame manages to fulfill this task, its intermediate product and the products of the following processing stages do not contain any information which allows drawing conclusions on the performance of the previous processing stages.

In accordance with a second aspect of the invention, at least the last autoleveller draw frame or the last evenness control unit before the spinning is defined as a master control unit which is responsible for the evenness of the intermediate products of the processing stages that are previous to this respective one and that supply it with material. Every autoleveller draw frame or evenness control unit can be arranged as such a master control unit.

Principally, every spinning mill preparatory machine for forming slivers, nonwoven fleeces or flocks could be provided with an own autoleveller draw frame or an evenness control unit and an evaluation means which are able to check the quality of the supplied material with respect to evenness by means of the control work carried out by the draw frame or the control means. A spinning line with such machines is effectively divided into sections, each ending with an autoleveller draw frame or autolevelling means, whereby said draw frame or autolevelling means serves, with respect to the evenness, as master control unit for the section allocated to it.

If it is not possible or desired that each preparatory machine is provided with an own autoleveller draw frame or its own autolevelling means, at least one autoleveller draw frame or autolevelling means is provided before the end spinning process, said frame or means serving, with respect to the evenness, as the master control unit for the section of the processing line that feeds said frame or means with feed material.

The invention, with respect to this aspect, may be applied both with regard to longwave as well as shortwave deviations in evenness, whereby different autolevelling means can be provided for varying types of deviations.

The signals obtained by this system can be combined with a material flow tracing system in order to allow or enable the diagnosing of malfunctions. A material flow tracing system that is suitable for this purpose is described in the DE-A-40 24 307 of Jul. 31, 1990 and in corresponding U.S. application Ser. No. 07/852,153, whereby this invention is not limited to the use in such a combination.

BRIEF DESCRIPTION OF THE DRAWINGS

The invention is now outlined in greater detail in examples by reference to the drawings, in which:

FIG. 3 shows a staple diagram of a typical fibrous material for processing in a so-called short fibre spinning mill;

FIG. 4 shows a schematical layout of a bale opener;

FIG. 5 shows a schematical side view of a fibre opening or cleaning machine;

FIGS. 9A and 9B show two time diagrams for explaining various measurement principles;

FIG. 10 shows a diagram for explaining various measuring arrangements for gaining a suitable signal in the combing room.

DETAILED DESCRIPTION OF THE PREFERRED EMBODIMENTS

The following description at first deals with the spinning line in its entirety and the process control system, then the composition of the material and the combing room, and finally the evenness and the autoleveller draw frame.

The Spinning Line

Figure 1:
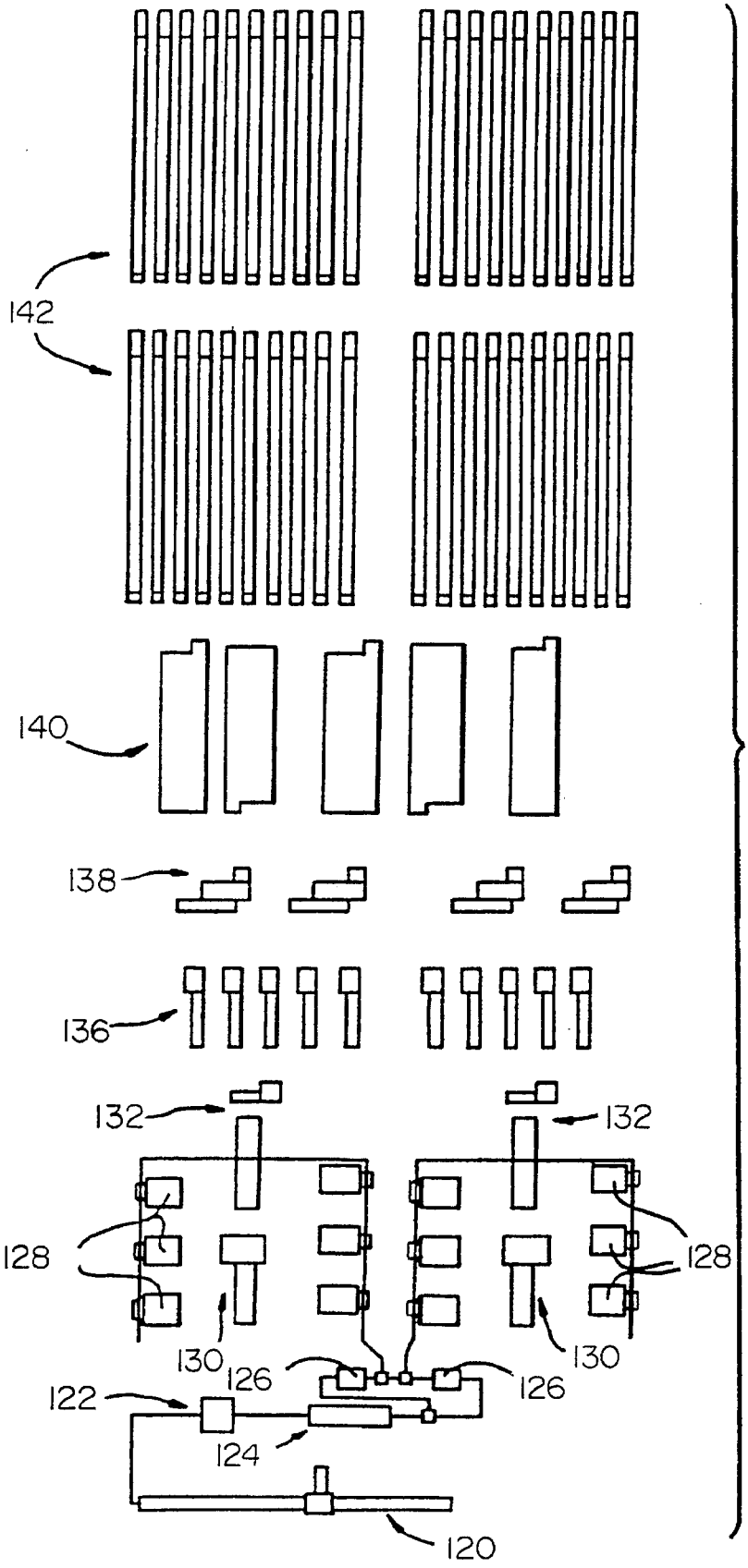
FIG. 1 shows a schematic outline of a spinning plant for the processing of fibre bales up to ,the spinning of ring-spun yarn.

The spinning mill as shown in FIG. 1 comprises a bale opener 120, a coarse cleaning machine 122, a mixing machine 124, two fine cleaning machines 126, twelve carding machines 128, two draw frames 130 (first drawing passage), two combing preparatory machines 132, ten combing machines 136, four draw frames 138 (second drawing passage), five flyers 140 and forty ring spinning machines 142. This is a conventional arrangement for producing so-called combed ring-spun yarn. The ring spinning process can be replaced by a newer spinning method (e.g., the rotor spinning process), whereby the flyers can then be left out. As, however, this invention deals with preparatory stages before the end spinning (plus any optional end spinning preparations in a flyer stage), the statement in connection with conventional ring spinning is sufficient for using the invention with new spinning methods. The combing room may be of importance in new spinning methods, particularly if higher qualities are required.

Figure 2:
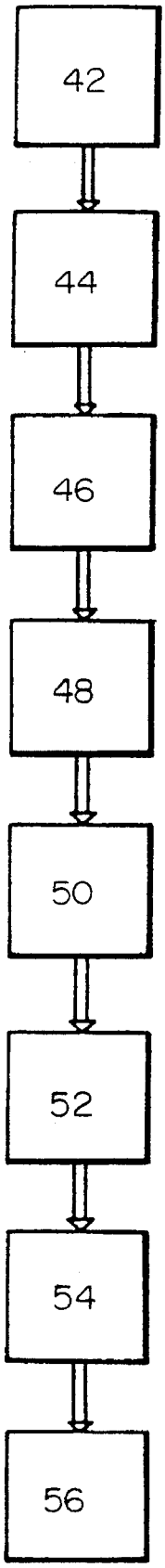
FIG. 2 shows a diagram for displaying the same spinning mill, whereby the various processing stages are shown for reasons of simplification without breaking down each stage into individual machines.

The spinning mill of FIG. 1 is again schematically shown in FIG. 2, whereby in the latter case the machines are combined to form so-called "processing stages". Accordingly, the bale opener 120 and the coarse cleaning machine 122, the mixing machine 124 and the fine cleaning machine 126 jointly form a so-called blow room 42 which supplies the carding room 44 with substantially opened and cleaned fibrous material. Within the blow room the fibrous material is conveyed in a pneumatic conveying system (air stream) from machine to machine, whereby the system ends in a carding machine. The carding machines 128 each supply a sliver as intermediate product which is deposited in a suitable container (a so-called "can") and conveyed further on.

The first drawing passage (through draw frames 130) and the second drawing passage (through draw frames 138) each form a processing stage 46 and 52 (FIG. 2), respectively. In between, the combing preparatory machines 132 form a processing stage 48 (FIG. 2) and the combing machines 136 form a processing stage 50 (FIG. 2). Finally, the flyers 140 form a spinning preparatory stage 54 (FIG. 2) and the ring spinning machines 142 form an end spinning stage 56 (FIG. 2). This application will not explain the latter two processing stages in greater detail.

The Process Control System

The process control system is no essential feature of this invention. The invention also offers advantages in the event that the obtained signals or information is used directly (without directing them through a process control system). The preferred embodiment, however, provides that the invention is used in combination with a process control system. Examples of such systems are briefly explained below.

Figure 6:
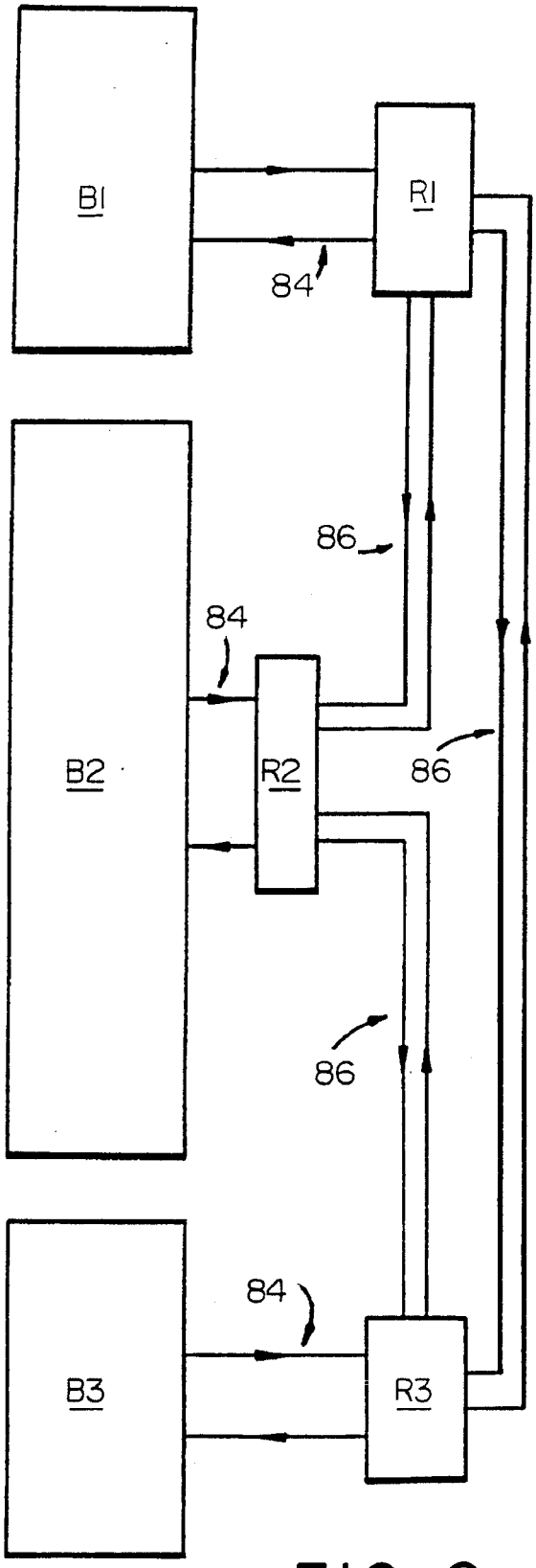
FIG. 6 PRIOR ART
FIG. 6 shows a schematic view of a process control system in accordance with our application DE-39 24 779 of Jun. 26, 1989, and U.S. Pat. No. 5,161,111.

In our German patent application No. 39 24 779 of Jun. 26, 1989 and U.S. Pat. No. 5,161,111 a process control system is disclosed according to which a spinning mill is organized in "areas" and by which signals from one area can be used to control previous areas. An example for such a plant is schematically shown in FIG. 6, whereby the plant comprises three areas B1, B2 and B3 and whereby each area is allocated its own process control computer R1, R2, R3. Each computer R1, R2, R3 is connected for exchanging signals with the machines or groups of machines of its own area (schematically shown in FIG. 6 by the lines 84) and the computers are connected with one another for the exchange of signals, too (schematically shown in FIG. 6 by the connections 86). It is quite obvious to the man skilled in the art that the view shown in FIG. 6 is purely schematical. Naturally, it is also possible that there is only one single process control computer which is connected with all areas of the spinning mill and which carries out the exchange of signals between said areas. The illustrated embodiment with one process control computer R per area B has proved to be a sensible arrangement, which will be used for the explanations below.

Area B1 comprises the blow room 42 and the carding room 44 (FIG. 2).

Area B2 comprises both the two draw passages 46, 52 (FIG. 2) as well as the combing preparatory stage 48 and the combing room 50.

Area B3 comprises the flyers 54 and the end spinning stage 56 (FIG. 2).

With respect to the preferred embodiment of this invention, areas B1 and B2 are of importance, whereby signals that are obtained in the combing room (area B2) are used for controlling the machines in the area B1 via computers R2 and R1. Details on how the respective signals are obtained are outlined below with reference to FIGS. 7, 8 and 9.

A process control system in the spinning mill is preferably programmed and designed or arranged for tracing the flow of the material. The importance of this task and proposals for a solution are provided in Uwe Behren's article "Computer-supported Transport Systems in Textile Manufacture" (Melliand Textile Reports, 7/1985, p. 499). The applicant's preferred solution, however, is contained in U.S. application Ser. No. 07/852,153 and in the German Patent Application No. 40 24 307.9 of Jul. 31, 1990 and the corresponding PCT application No. PCT/CH91/00151, which will be filed until Jul. 31, 1991.

An additional important task of a process control system is operational support (i.e., assistance to the operating staff). Present conventional spinning mills comprise a number of devices, programs and auxiliary means which help the operating staff to carry out the complex tasks quickly and efficiently. In the "fully automated" spinning mill of the next generation it will be necessary to principally integrate the operator supporting means into the process control system. Such a solution has already been proposed by the applicant in U.S. application Ser. No. 07/778,813 and in the PCT application PCT/CH 91/00097.

The "architecture" (the arrangement) of the process control system is also of importance because of the complexity of the spinning line, particularly with respect to information transmission. Proposed solutions in U.S. application Ser. No. 07/927,307 and in this respect are contained in the Swiss Patent applications No. 189/91 of Jan. 23, 1991 and No. 1025/91 of Apr. 5, 1991.

The Composition of the Material

The final result of the schematically displayed spinning process is influenced by a large number of factors, which will not be explained here in greater detail. One important factor is the raw material to be processed, which can be regarded as a group of individual, ascertainable fibre qualities (e.g. fibre fineness, type and strength of fibre, etc.).

One essential quality for the final result of the spinning process is the fibre length, which can only be ascertained and displayed properly by statistical methods in relationship to the number of fibres that have to be processed. The fibre length quality of a certain raw material is therefore represented by a so-called staple diagram (FIG. 3) (see also page 24 of the manual "Textile Fibres: Testing and Quality Control"; Author: S. L. Anderson in Manual of Textile Technology, Quality Control and Assessment; Publisher:

The Textile Institute). The proportion (percentage rate) of fibres in a given length range can be evaluated for the respective raw material by this diagram. The importance of the fibre length for the spinning is known from the manual "Technology of Short Staple Spinning", author: W. Klein in Manual of Textile Technology, Short Staple Spinning Series, (Vol. 1), publisher: The Textile Institute.

When processing natural fibres (in particular cotton fibres) it is not possible to "order" raw material with a predefined staple diagram. On the contrary, it is necessary to produce the desired diagram by Suitably processing fibres from various sources ("origins"). In particular, three processing stages have a decisive influence on the material to be spun, which are:

the blow room the carding room the combing room

The effects of the blow room and the carding room are briefly described below, because these stages are only indirectly affected by the present invention:

The Blow Room

In principle, there are two ways to influence the staple diagram of a raw material in the blow room or carding room, namely:

by supplying fibres of varying lengths (origins), and by the intensity of the fibre processing, whereby a higher intensity automatically leads to a higher rate of damage (shortening) to the fibres.

Examples of these two options are schematically outlined in FIGS. 4 and 5.

FIG. 4 schematically shows a bale opener of the present conventional type with a tower 60 which can move back and forth along a duct 62. The tower 60 comprises an extension arm 64 with a bale opener unit (not shown). The fibre bales are placed the application form of bale groups 66, 68, 70, 72 next to the duct 62. During the reciprocating movement of tower 60 with the: extension arm 64 disposed above a given bale group (in FIG. 4 above bale group 68), the opening unit removes fibre flocks from the surface of the bale and feeds them to duct 62 by way of a pneumatic conveyor system (not shown). The conveyor system mentioned above then supplies said fibre flocks to the other machines of the blow room and, finally, to the carding room.

If the bale groups are arranged according to their origin (so that, for example, fibres of a first origin are placed in bale group 68 and fibres of a second origin are placed in the bale group 66), the staple diagram of the material to be spun can be influenced in such a way that the bale opener conveys a larger amount of fibres for processing from, for example, bale group 68 than from bale group 66. In such a way the so-called fibre mixture can be influenced very roughly.

A further development of the conventional system has been shown in U.S. Pat. No. 5,025,533 and U.S. patent application Ser. No. 07/536,205, as well as in the European patent applications EP-A-0 362 538 and EP-A-0 402 940, wherein the fibre mixture is made as desired. The respective process requires a control unit which has to be arranged in connection with the stages blow room/carding room.

FIG. 5 schematically shows a rotatable drum 74 of a cleaning machine, e.g. a fine cleaning machine 126 (FIG. 1). Said drum 74 cooperates, for example, with a grate consisting of individually adjustable grate rods 76 (only one grate rod 76 is shown in FIG. 5). Each grate rod 76 is rotatable about an axle 78 and comprises a work head 80 at its end adjacent to drum 74. By displacing grate rod 76 about the axle 78 it is possible to change the position of the work head in respect to drum 74. This measure has an influence on the intensity of the processing during the cleaning of the material. A more intense processing means a higher degree of cleaning. On the other hand, it also means more damage to (shortening of) the fibrous material to be processed. The setting of the rods 76 can also be carried out manually. It can also be made automatically by means of servomotors 82. Other places where it is possible to carry out more intensive fibre processing at the expense of higher damage to the fibres (shortening) are the bale opening room and the carding room. A method which makes direct use of this effect is shown in U.S. patent application Ser. Nos. 07/785,237 and 07/905,531, as well as in the European patent applications EP-A-0 399 315 and EP-A-0 409 772.

The Combing Room

The last stage that has an influence on the staple diagram of the raw material to be spun and that determines said diagram for the end spinning process is the combing room. The function of said stage is first outlined below. It is assumed that present, conventional combing machines are used, so that it is unnecessary to explain in detail the design (arrangement) and operation of a combing machine. Such details, for example, are known from the book "Drawing, Combing and Roving", author: Zoltan S. Szalocki, publishers: The Institute of Textile Technology or from the manual "A Practical Guide to Combing and Roving", authors W. Klein in Manual of Textile Technology, Short Staple Spinning Series, (Vol. 3), publisher: The Textile Institute. A modern combing plant is described in the article "The Combing Room as the Decisive Profitability Factor in Short-Staple Spinning" by Dr. G. Mondini in Melliand Textile Reports, 5/2990, p. 330ff.

The above sources clearly indicate that the essential function of a combing machine consists of filtering out fibres of an ascertainable minimal length from the process as wastage. This effect can be explained very clearly in connection with the diagram of FIG. 3. It is assumed that the blow room 42 or the carding room 44 supplies to the combing room 52 a raw material with the fibre characteristics C in accordance with the staple diagram of FIG. 3. The combing machines 136 (FIG. 1) of this combing room are set in such a way that they filter out all fibres as wastage that are shorter than X mm (it serves as a "separating point" with respect to the short fibres). Under these assumed prerequisites, the filtered short fibres constitute a proportion of Y% of the feed material supplied by the preparatory stage 50 (FIG. 2). The situation as shown in FIG. 3 constitutes the scheduled condition. Deviations from this scheduled condition can be determined by the proportion of short fibres that are filtered out in the combing room. This allows using means for controlling the blow room and/or the carding room. Note must also be taken of the fact that the combing machine not only filters out short fibres, but also filters out neps and soil. However, these amounts of wastage are negligable in comparison to the amounts of short fibres that are filtered out.

Figure 7:
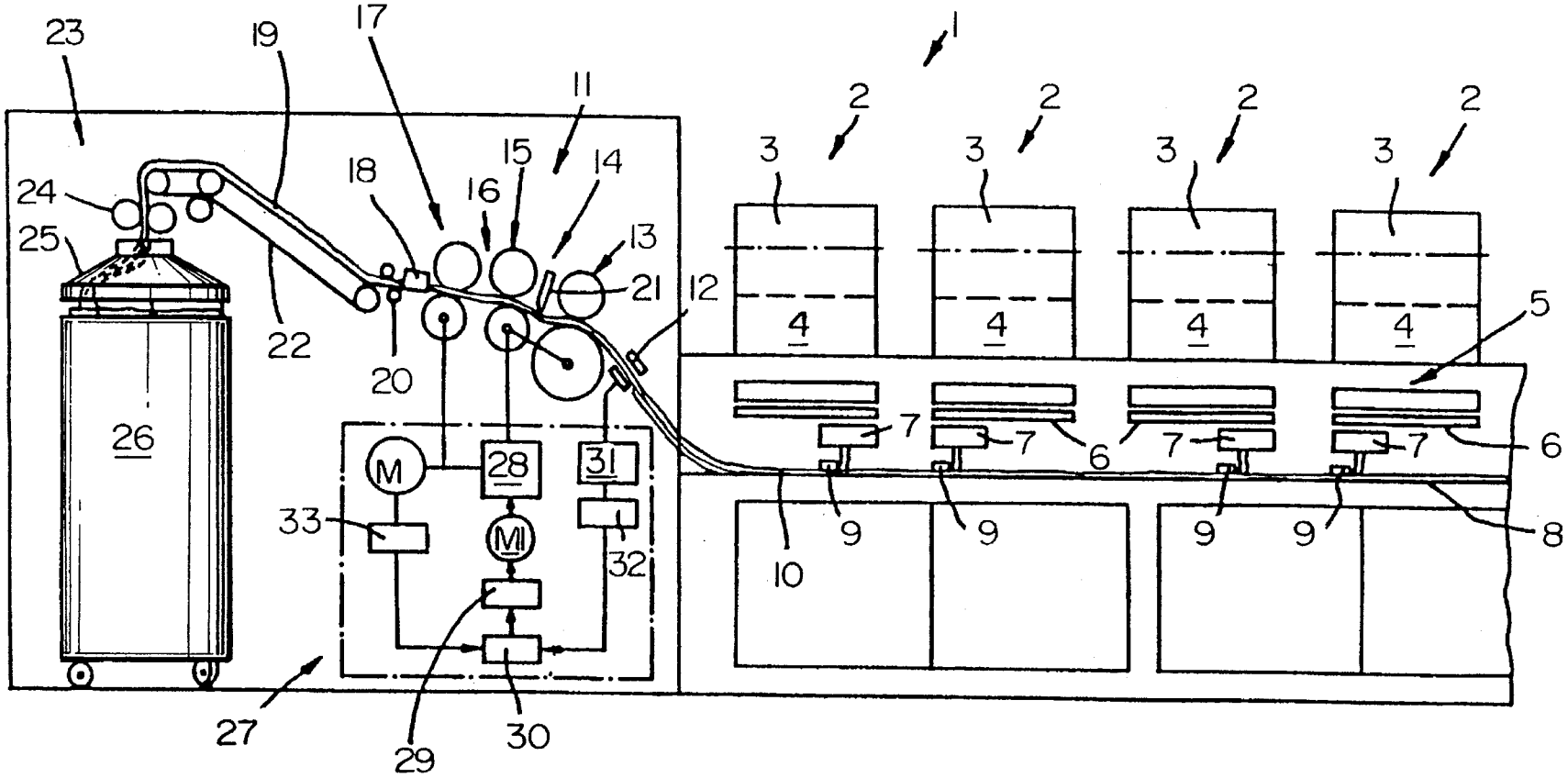
FIG. 7 shows a schematic side view of a combing machine in accordance with our German Patent DD 286 376 and U.S. Pat. No. 5,230,125.

FIG. 7 is a copy of FIG. 1 of U.S. Pat. No. 5,230,125 and our earlier Swiss Patent application No. 4754/88 (DD 286 376) and shows a schematic side view of a combing machine with a controlled drafting device. Only the basic structure of the combing machine (without considering the draw frame control unit) will be explained hereinunder at first.

Figure 8:
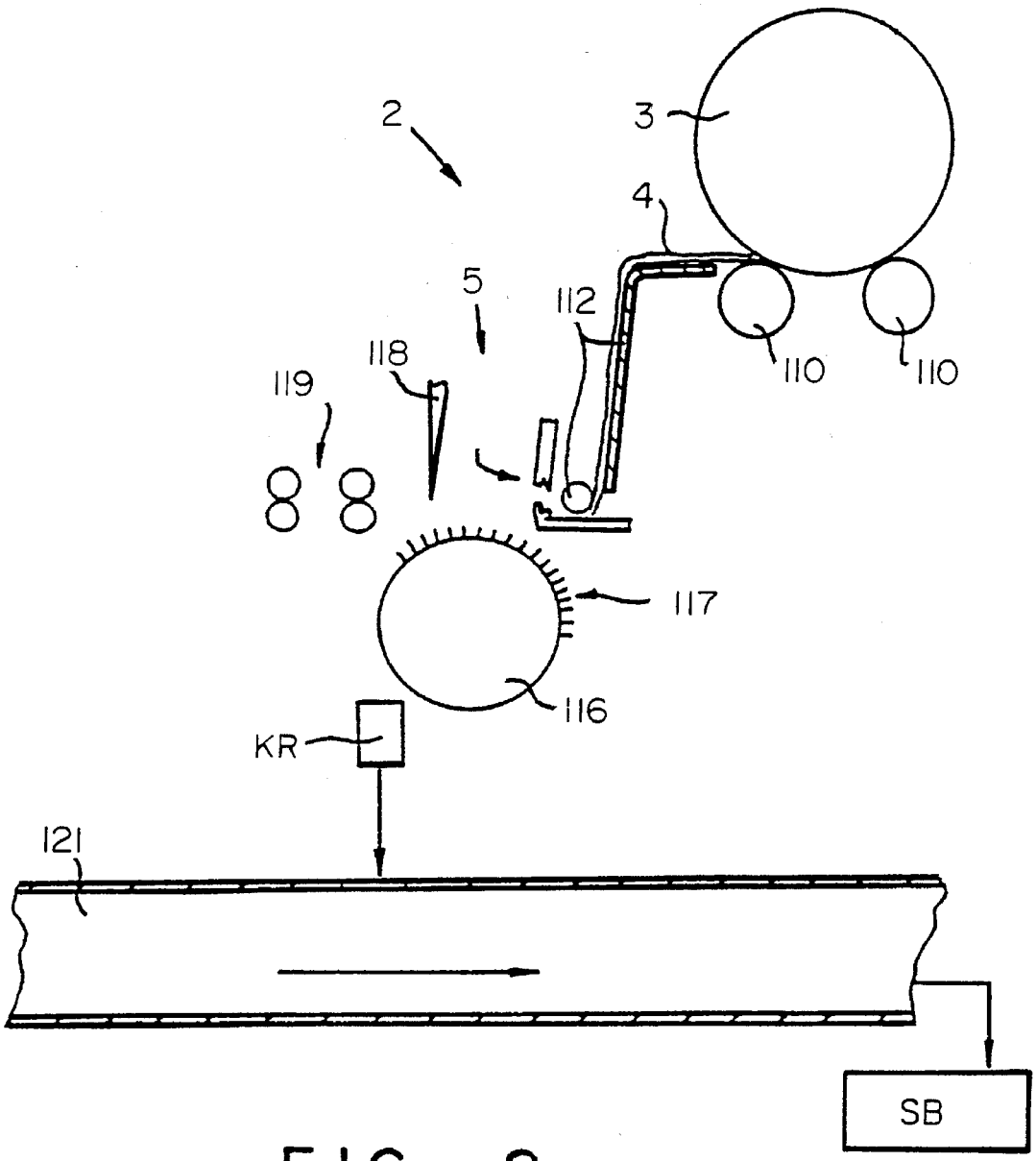
FIG. 8 shows a schematic view of a single combing head of the machine in accordance with FIG. 7.

FIG. 7 shows a combing machine 1 with, for example, eight combing heads 2, of which only four are shown in the drawing. A single combing head 2 is schematically shown in a larger scale in FIG. 8 (with a view in the longitudinal direction of the machine). On the carrier rollers 110 (FIG. 8) in each combing head 2 there is a lap roll 3 whose lap 4 is supplied to the combing apparatus 5 through a supply means 112 (FIG. 8). As is generally known, the combing apparatus 5 may consist of a nippers unit 114 (FIG. 8), a circular comb attached under said unit and, with respect to the conveying direction, a top comb 118 arranged behind said nippers unit. Behind said top comb are arranged detaching rollers 119.

The combed fibre fleece supplied by the detaching rollers 119 reaches a draw-off funnel (not shown in greater detail) over a delivery table 6 (FIG. 7). In the draw-off funnel the fibre fleece is combined to form a sliver or a combed sliver. This process is supported by a pair of draw-off rollers 7 that are arranged behind the respective draw-off funnel. Said rollers supply the combed sliver to an outlet table 8. In order to continue the conveyance of the slivers 10 next to each other on the outlet table 8, sliver guiding means 9 are provided which are displaced from one another in the horizontal direction. The slivers 10 guided parallel towards each other reach a draw frame 11, whereby a measurement unit 12 is provided at the entrance of the draw frame 11. Said measurement unit scans the thickness of the incoming slivers. The measurement unit 12 can be arranged in a number of ways, for example optically or mechanically.

After passing the measurement unit 12 the slivers reach a central pair of rollers 15 between the feed rollers 13 of a preliminary draft zone 14. Said central pair of rollers 15 simultaneously form the feed rollers for a subsequent main draft zone 16. The drawn slivers 10 reach a schematically shown sliver funnel 18 through the delivery rollers 17 at the outlet from the main draft zone 16. There they are combined to a combed sliver 19 by means of the draw-off rollers 20. A pressure bar 21 is attached in the preliminary draft zone for guiding the slivers. This pressure bar 21 could also be arranged in the main draft zone.

The combed sliver 19 supplied by the draw-off rollers 20 reaches a conveyor belt 22 and is conveyed to a can frame 23. The combed sliver 19 is deposited in a can 26 by means of calender rollers 24 and the funnel wheel 25.

The shorter fibres are picked up by the wire setting 117 (FIG. 8) of the circular combing and removed from the circular comb 116 by means of a comb cleaning means KR. The cleaning means conveys these separated short fibres to a suction duct 121. Said duct 121 passes all eight combing heads 5 and conveys the wastage from said heads to a collecting container SB. The separated material can, for example, be used in a recycling process again. However, this process is not of importance for the present invention and shall therefore not be described hereinunder.

In accordance with FIG. 3 it is desired to obtain a signal which is equivalent to the proportion of short fibres of the feed material for the combing room. This is achieved by a suitable arrangement of measuring sensors. In principle it would be possible to individually measure the proportion of short fibres in each combing head, which would ensure a precise supervision of the combing stage itself. However, such an arrangement would result in high investment and maintenance costs and would cause considerable efforts in setting the various measuring devices. In a preferred embodiment of the invention the proportion of short fibres is not measured or obtained for each combing head, but for each machine, which means that only one arrangement of measuring sensors per machine is necessary. This arrangement is connected with the process control computer R2 (FIG. 6) for the area B2 of the spinning plant. Further details on measuring and obtaining the proportion of short fibres are outlined below in greater detail. At first, however, the evaluation of the signals from the combing machines (FIG. 1) in computer R2 (FIG. 6) is explained.

It is assumed at first that a scheduled value with upper and lower tolerance limits is defined for the proportion of short fibres. As long as the signal supplied from each combing machine to the computer R2 indicates that the separated proportion of short fibres is within the predetermined tolerance range, there is no reason for computer R2 to intervene in the process with respect to the staple length. If a change in the signal from one combing machine indicates that in this machine the proportion of separated short fibres has drifted outside of the scheduled tolerance range, a similar deviation would usually be noticed in the other machines (which process the same raw material) within a predefined time interval in the event of deficient raw material. Therefore, computer R2 should at first wait whether similar deviations from the scheduled .values occur in all machines of the group. If the deviation persists in only one machine, the error cannot be caused by deficient raw material, but only by a malfunction in the respective machine or in the measuring instruments attached to said machine. Under these circumstances computer R2 should switch off the respective machine and set a display, so that the operating personnel can eliminate this malfunction.

If a simultaneous drift of the measured or obtained proportion of short fibres occurs in all combing machines of the group, it is obvious that the error is caused by deficient raw material. Computer R2 then sends a respective signal to the process control computer R1 which is responsible for controlling area B1. The computer R1 can then either initiate a display, so that the respective new settings can be carried out by the operating personnel, or (by making use of the various options for influencing the staple length) initiate a change in the processing to bring about the desired condition in the feed of the combing room again. These options have been outlined in connection with the FIGS. 4 and 5.

In the event of conflicting messages from various machines in the combing room the computer R2 will come to the conclusion that there is a malfunction in the plant and therefore will raise a respective alarm.

If a control system is to be introduced, it is necessary to take into account the "delay period" between the detection of an error and the arrival of the corrected material at the scanning position of the sensor. If this delay period is too long, it is recommended to refrain from using a control system. If, for example, the "delay period" (as seen from the respective control system) between the carding room and the combing room is more than several hours, .it is possible that the error in the blow room has already been "eliminated" by the complete processing and replacement of the deficient material when the error is detected in the combing room. In such an event the operating personnel should be notified of the error by an alarm, so that material that is still "being processed" (also between the carding room and the combing room) can be checked. This is also of importance for present conventional spinning mills, in which delay periods between the carding room and the combing room can amount to several days.

With respect to the considerable delays between detecting an error in the raw material in the combing room and the subsequent correction of this error in the feed material of the combing room itself, it does not make sense to transmit continuously or quasicontinuously a deviation signal from computer R2 to computer R1. It also does not make sense to react to brief deviations in the results of the measuring and evaluation process. It is advisable to take the mean of these deviations over certain time intervale into account in order to obtain certain tendencies. The suitable time interval has to be established on a case to case basis. It depends both on the runtime of a lap charge 3 (FIG. 7) and the delay time within a possible control system.

Within this time interval it is possible to measure either continuously (analogue) or discontinuously. The type of evaluation can be determined from case to case with respect to the results of the measuring and evaluation process, as will be outlined now in greater detail by reference to the diagrams 9A and 9B. In both diagrams the time is represented on the horizontal axis and the measured or evaluated proportion of short fibres is represented on the vertical axis. Both diagrams are based on a predefined measuring or evaluation interval I. In FIG. 9A it is empirically established that the results of the measurement show an irregular curve (characteristics), whereas the results of FIG. 9B show a regular curve. In both cases a discontinuous measuring or evaluation method is assumed, which are represented here by five "measuring points of time" MT within the interval I.

In a system in accordance with FIG. 9A it is hardly possible to establish a tendency within the interval I. The results of the measurement have to be collected for the whole interval and compared with the measurement results of earlier intervals by means of suitable evaluation in order to establish a tendency. The computer R2 can therefore only determine a defect in the raw material at the very earliest at the end of interval I and then transmit a respective signal to computer R1. In case 9B, on the other hand, it is possible to establish the rising tendency of the proportion of short fibres even within interval I, so that it is possible to intervene earlier in the process within a specific interval I. Computer R2 can be programmed in such a way that it checks the supplied measurement results for predefined tendencies (e.g. the constant rise in accordance with FIG. 9B) and reacts in accordance with the results of the check. This computer, however, must in any case be programmed for the treatment of measured values in accordance with FIG. 9A, as it is not possible to predict whether or not (and if yes, which) tendencies will occur.

FIG. 10 shows a diagram for explaining various options for measuring or evaluating the proportion of short fibres in the feed material of a specific combing machine 1 (see also FIG. 7 or 8). The arrows show the flow of the material. The arrow V indicates the supply of the feed material in machine 1. The arrow L shows the supply of the intermediate product (sliver) of the machine and the arrow A indicates the wastage (comb waste). If V, A and K are regarded as amounts of material per time unit, the conditions can be represented by the following equations:

$$V-A=L \tag{1}$$

or $$A=V-L \tag{2}$$

It follows that the proportion of short fibres (KFA) can be established by the following equation:

$$KVA\,\frac{A}{V}=\frac{V-L}{V}=\frac{A}{L+A}=\frac{A}{X} \tag{3}$$

This means that the proportion of short fibres can be determined by measuring A and V or by measuring V and L or by measuring A and L (in accordance with a suitable system in accordance with FIG. 9A or 9B). Under certain circumstances it is possible to determine the proportion of short fibres sufficiently precisely by measuring the amount of comb waste A and by determining a value X, said value being an assessed value which approximately represents the amount V of the feed. The value X can, for example, be derived from the production that is set for the combing machine. From FIG. 10 it is clear that there are a wide number of ways to measure or determine the proportion of short fibres. The amount of waste A should be measured or determined in the combing machine 1 itself. The amount V of the feed could, for example, be provided by the preparatory stage 50 (FIG. 2). The delivery L can be determined in the can frame 23 (FIG. 7).

The combing machine has a clearly ascertainable influence on the staple diagram of the raw material to be spun in that this machine takes the shorter fibres out of the processing. The amount of wastage in the combing machine clearly proves this influence, because the tomb waste consists nearly exclusively of short fibres (the amount of dirt in the comb waste and the neps contained therein are negligable in this respect). The amount of wastage directly indicates the proportion of short fibres for given settings of the combing machine and for a given arrangement of the feeding lap (lap thickness or the degree of parallelization of the fibres). This statement applies to present combing machines. If in the future the percentage rate of dirt and neps in the comb waste increases in such a way that it can no longer be neglected, it would be possible to determine fixed proportions Of these components by making samples thereof in laboratories.

The combing machine itself can be set in such a way that fibres that are shorter than a predefined length are separated, so that the following stages need not cope with problems caused by short fibres (separator function). It follows from this that after the combing room there is no more "information" with respect to the performance of the previous stages in connection with the short fibres in the material itself. The information is "erased" in the combing room.

The final results of the spinning process, however, depend on many other factors, in particular on maintaining the sliver count and the CV-values for these slivers. Therefore it is particularly advantageous to arrange the draw frame 11 (FIG. 7) of the combing machine as an autoleveller draw frame. For reasons of completeness the control unit 27 for the draw frame 11 will also briefly be described hereinunder, although this arrangement is not bindingly required for the use of the invention in connection with the Composition of the material.

The drive of the lower roller of the roller pair 13, 15 and 17 is carried out by the main motor M, whereby a planetary gear is arranged in-line for the drive of the lower roller 15 and the drive of the lower roller 13 is taken directly from the lower roller 15. A control motor M1 is allocated to the planetary gear 28, whereby said motor is controlled by the control device 29. The control device 29 receives pulses from a scheduled value stage 30 in which the measured voltage initiated by the measuring unit via the signal converter 31 and a timing signal generator 32 is compared with the control voltage issued by the control speedometer 33 of the main motor M, which results in a scheduled voltage for the control device.

Before entering the calender rollers 24 there is additionally provided a sliver monitor for monitoring the controlled combed sliver.

If the measuring unit 12 registers a deviation from the scheduled silver thickness, the control motor M1 is activated with a delay via the control unit 27, said motor engaging in the planetary gear and effecting a change in the number of rotations of the central roller 15 and thus also the feed roller 13. The delivery roller 17, on the other hand, maintains its speed. This means that the draft is adjusted to the silver thickness determined by measuring unit 12 by means of a change in the difference in speed between the central roller 15 and the feed roller 17. In order to protect the combing machine itself from this change of speed in the draw frame inlet, a buffer storage means can be provided before the draw frame. The controlled draft zone may also be located between the pair of rollers 15 and 17. In this event the pair of rollers 17 would have a variable speed. The buffer storage means would be disposed between the draw frame outlet and the chamber press.

As will be described below, it is also possible that draw frames with other designs and with other control means are used instead of those described herein.

Another possible arrangement consists of arranging a further pair of rollers (not shown) behind the pair of draw-off rollers 7, whereby the additional pair of rollers is driven with a higher speed to apply a minute predraft to the sliver before it reaches the delivery table and is twisted with the other slivers.

Finally it is necessary to adjust the total production of the combing room to the "demand" of the end spinning process. Preferably, the control of the amounts is effected in such a way that the combing room has a certain overcapacity with respect to the production performance and that the individual machines are operated in accordance with the so-called "stop/go" mode. In the event of higher demand by the end spinning stage the stop/go ratio is decreased and in the event of decreasing demand this ratio is increased. If for any reason it is not desired to operate the combing machines in the stop/go mode, the nip number of the comb of the individual machines can be increased or decreased in order to adjust the supplied amount per time unit to the demand of the end spinning process. These settings have no influence on the importance of the measurement or the determination of the proportion of short fibres. The measurement or determination of the proportion of short fibres can .be carried out and exploited irrespective of other quality features such as the sliver count or CV. The problems concerning the maintenance of the sliver Count or smoothing CV deviations can, for example, be transferred to other processing stages (for example to the second draw passage 52, FIG. 2. The invention can therefore also be realized if the combing machines do not comprise a controlled draw frame. Such draw frames, however, are important for the invention's second aspect.

Evenness and Autoleveller Draw Frames

The importance of evenness for the spinning is evident from the manual "Technology of Short Staple Spinning" as mentioned above., Present conventional means for levelling are described in the above-mentioned book "Drawing, Combing and Roving" or in the above-mentioned volume 3 of the Short Staple Series of the Textile Institute, "A Practical Guide to Combing and Roving".

Signals to be Gained from the Autoleveller Draw Frame

The sensors in the feeding or delivery section each supply a signal which is equivalent to the deviations in evenness of the sliver or fleece passing the respective sensor. These signals, however, cannot necessarily be used without further treatment, as can be seen from the European patent application No. 0 412 448 and U.S. Pat. No. 5,134,755 the Swiss patent application No. 3100/90-4 of Sep. 26, 1991 and U.S. patent application Ser. No. 07/765,570. It is possible to generate signals from the mentioned two signals (possibly with adjustments in accordance with the applications mentioned above) which represent the so-called adherence to the count (longwave deviations—"drift") as well as the V-values (shortwave deviations).

It is, however, also possible to gain the desired information from a further signal, i.e. the so-called control signal that is used for controlling the controlled motor.

It has long been known to test the evenness of an intermediate product in the laboratory (off-line) by gaining respective signals and then, if necessary, to intervene in the process. The theory concerning the tests has been developed intensively and allows coming to conclusions on the processing stage which caused a predefined error. For further details refer to the operating manual "Evenness test" of the Zellweger company, Uster AG, Switzerland (page 129ff).

In the course of the eighties it has become possible to obtain the necessary signals during the operation (on-line) and to make, said signals available to the operating personnel through a display for diagnosing malfunctions. This system is provided by the "SLIVER DATA" system of the Zellweger company, Uster (see the above-mentioned volume 3 of the Short Staple Spinning Series). This apparatus even supplies a spectrogram of the fed and delivered material. However, it has not yet been proposed to evaluate the signals thus obtained through a process control system and to use said signals for controlling the previous stages.

The Autolevelling Draw Frames as a Component for Determining the Evenness

The draw frame of the second passage (138, FIG. 1) is used in the conventional spinning mill as the stage that protects the end spinning stage from deviations in the evenness of the preparatory machines (blow room, carding room and preliminary draft frame; the second passage is used as a "separator" in respect of evenness). The draw frames Of the spinning stages (flyer or end spinning machine) are not automatically adjustable and therefore cannot compensate errors in the feed material.

Modern draw frames of these stages are presently often provided with a regulating means and a controlling means, whereby the regulating means is used to maintain the sliver count and the controlling means is used to ensure the adherence to a predefined CV-value. The controlling function is particularly important after the combing room (due to the mode of operation of the combing machine), see the books mentioned above. As long as the draw frames of this passage fulfill the desired functions, it does not make sense to investigate the performance of the previous stages for the results in the spinning stages as the respective information is not or no longer contained in the material to be spun.

The draw frame of the second passage is mostly not the only processing stage that is provided with an evenness controlling and regulating means. In principle it would be possible to provide each processing stage with an own evenness controlling means/evenness regulating means, which need not necessarily be combined with a draw frame (see, for example, the U.S. Pat. No. 4,271,565). To equip each preparatory machine with its own evenness regulating means would in any case be very expensive and, due to the high costs, is usually not taken into account. Even if this expensive arrangement is realized under certain circumstances, it is possible to determine the last stage before the spinning as the control unit in the sense that the results of the previous stages are checked here through the process control system and, if necessary, measures are undertaken in said previous stages.

Even if, however, more than one stage is provided with an evenness control or regulating means, the control or regulation of the stage disposed in front of the separator will be less efficient than the control or regulation of the separator itself, because repeated interventions in the feed material usually do not lead to an improvement in the quality of the material, but to a deterioration in the quality. Therefore it applies, also for technical reasons, that such interventions should be provided at the fewest possible positions, at least with respect to shortwave deviations in the evenness. With respect to longwave deviations, however, it can be preferable to provide the suitable control or regulating means in stages situated immediately in front, in particular in front of the carding machine.

An autoleveller draw frame for compensating shortwave deviations in the material is necessary after the combing stage in order to compensate the piecing to the utmost extent. As was already shown in connection with the composition of the material, it is possible to integrate a "drawing passage" arranged behind the combing in the combing machine itself, i.e. the combing machine can serve as a "separator" both for the proportion of short fibres as well as for the "preparatory evenness". The term "preparatory evenness" in this context means the evenness of the feed material that is supplied to the spinning stage and that cannot be improved any more with respect to its evenness.

As was already shown in connection with the composition of the material, an increased wastage of short fibres causes a loss in material, which means a respective change in the evenness that is noticeable in the autoleveller draw frame arranged behind the combing machine, i.e. additional regulating work is necessary to supply a sliver with a predetermined count to the spinning stage.

If an autoleveller draw frame is built into the combing machine itself, it is possible that a correlation between the regulating work and the separating work in the machine control unit can take place, whereby said machine control unit receives both the comber waste measuring signals and evenness value signals. If the combing machine is not provided with an autoleveller draw frame, a process control computer can carry out the required correlation if the necessary output signals of the two process stages are supplied to it.

This correlation helps to avoid erroneous conclusions, which could otherwise arise because the essential tasks of the combing machine (namely, the separation of short fibres) lead to a change in another quality (the evenness). This change in evenness must not be regarded as "erroneous behaviour" in the preparation with respect to the evenness, but must be evaluated (like an increase in the amount of the combed waste) as the symptom of a defect in the material or in the processing of the material.

Interventions by the Control or Regulating Unit

Tolerance limits for the material supplied to the separator can now be determined in the process control computer, so that no interventions are made as long as the deviations in the evenness of the incoming material are within these tolerance limits. The tolerance values can be adjusted to the performance of the separator in such a way that, for example, if a deterioration of the incoming material is noticed, an intervention is not carried out as long as the separator is able to cope with the deviations in evenness with a minimum safety margin. An intervention becomes necessary if it is noticed that the deterioration has reached the safety margin. It is also possible to evaluate tendencies beforehand, as was described in connection with the composition of the material, so that an intervention can be carried out earlier if it is noticed that a continuous deterioration has begun, because deteriorations and improvements should approximately balance one another over the time in normal operating conditions.

However, the system can also be used to "optimize" the line in the sense that a deterioration of the quality of the previous stages is initiated if the separator still has unused reserves. As the quality is usually achieved at the expense of the production, such a procedure can lead to a more efficient exploitation of the interactions between the processing stages with respect to production and quality. The same applies to the selection of the raw materials. By mutually adjusting the production in the various stages by means of the process control computer it is possible to empirically determine the optimal settings for more sensitive materials or the effects on cheaper materials.

The spectrogram is of the utmost importance for the evaluation of the evenness test. Only this analyzing means enables the identification of the error source (see the above-mentioned manual of the Zellweger AG, Uster). In the preferred embodiment of this invention the evenness signals of the Separator are obtained in such a way that they allow the Spectrum analysis.

The spectrum analysis, however, allows at best the identification of the processing stage that has caused a particular error. The identification of a certain machine as the source of the error requires tracing the flow of the material. Systems for tracing the flow of the material are known, but they are very expensive. In order to limit the length of this description, the tracing of the material flow Will not be treated as such in this application. The combination of the present invention with tracing the flow of the material in the process control system is, however, the preferred embodiment and a material flow tracing system suitable for this purpose is described in the above-mentioned German patent application No. 40 24 307 and in U.S. patent application Ser. No. 07/852,153. The statements contained in said application are hereby included in the present description by this reference.

Tracing the flow of the material is based on simulating the flow of the material in a computer or a computer system (with a plurality of computers connected to each other. For this simulation "material units" are defined which can be recorded in the plant by means of the sensors. The plant is provided with such an arrangement of sensors that (1) the paths of the material through the plant are divided into Sections between the sensors, whereby the allocation of a material unit to a section represents a locating precision that is sufficient for tracing the material flow and (2) the sequence of the movement of the material units past the sensors allows the definite identification of the units (without having to mark the units).

The sensors are connected with a computer (system) in such a way that the movement of a material unit past a sensor is registered by the computer (system) and allocated to a time coordinate. The material units therefore are provided with both location and time coordinates which are stored in the computer for such a period as to allow the determination of the flow of the material at a later time, i.e. at least up to the point of time at which said material units leave the plant.

Preferred Embodiments of the Autoleveller Draw Frame

The second aspect of the invention relates to the application of autoleveller draw frames, i.e. draw frames in which the draft can be controlled or regulated in order to balance deviations in the material of a supplied fibre structure. Such draw frames are often used in so-called autolevellers in short-fibre spinning mills. They can, however, also be used in carding machines, combing machines and combing preparatory machines in short-fibre spinning. The same principles are naturally suitable for the use in long-staple spinning mills.

The principles of control engineering have been applied for several decades in autoleveller draw frames. They have enabled the continuous improvement of the quality of the fibre structures to be processed (to the extent that this quality was only defined by the evenness of the mass per unit of length).

In the same period of time intensive efforts have been made to gain a clear definition of the term "quality" with respect to the evenness of the fibre structure. These efforts have led to generally accepted testing methods with the subsequent availability of suitable testing devices.

By means of the presently applied technology in combination with a quality-oriented organization of the spinning mill nearly every spinning mill is in a position to avoid or correct most of the (relatively major) defects and to produce fibre structures of good average quality.

Due to continuously rising demands in the quality it is now necessary to further raise the already good quality level. Thus, technical areas are reached in which it is no longer sufficient to apply the basic principles of control engineering or the basic principles of statistical quality control in the spinning mill. In order to achieve a further substantial improvement the quality it is now necessary to take a closer look at the more intimate interactions between the applied measuring principles, control principles, drive systems, drafting forces and material qualities. In this respect it is necessary to bear in mind the principles of the evenness test for sliver structures, which have already been determined by standards.

The quality control in the spinning mill is presently mostly carried out in the laboratory ("off-line"). For this purpose samples are collected from the processing line, carried to the lab and tested. The test results are to provide conclusions on the settings of the machines or to allow making adjustments to the material to be processed in order to fulfill the quality requirements of the desired final product. The leading manufacturer of testing equipment is Zellweger G, Uster, Switzerland. The user manual of this company titled "Evenness Test" comprises approx. 230 pages and describes at least six different test criteria which supply various information about, evaluating the evenness of a fibre structure (i.e. the diagram, the imperfections or rare defects, the spectrogram, the mean factor and the length variation curve).

There is enough time in the laboratory (off-line method) to analyze the information, to come to a suitable interpretation of the various results and to the respective conclusions. If, however, such methods are applied in normal operation "on-line", whereby it is intended to intervene in the process based on measured values that were just obtained, it is hardly surprising that there is a high risk of erroneous conclusions.

The previously mentioned proposals for a more precise examination of products in the operation ("on-line") are not aimed at allowing interventions in the processing, but at initiating an alarm, at collecting operational data or analyzing a process (e.g. U.S. Pat. No. 4,758,968), so that a closer examination can be carried out by the personnel or that the staff can carry out purposive support work. A system in accordance with the DE-PS 32 37 371 and GB 2,132,382 belongs to this category. According to these disclosures a yarn produced in accordance with a jet-spinning process is tested both with respect to the spectrogram and the Uster value (unevenness coefficient). This allows identifying errors in the drafting device of the jet-spinning machine itself, which can lead to an exchange of the deficient parts. This method, however, does not allow conclusions on the performance of the preparatory stages.

A proposal for monitoring a draw frame was made in EP 340 756. In accordance with a first variation of this proposal limit values are to be determined for a signal supplied by the outlet measuring unit, whereby an alarm can be raised or the machine turned off if a limit value is exceeded. In this case the product (the supplied silver) should be checked by the staff. The results of this check are to provide conclusions on measuring or controlling errors.

A second variation of the same proposal provides the determination of limit values for the control signal that defines the draft, whereby here, too, an alarm is raised or the machine is turned off if a limit value is exceeded. In this case the feed sliver should be checked by the staff. The results of the check are to provide conclusions on errors in the inlet measuring system or the production of the feed material (i.e. in the production machines before the draw frame).

The monitoring of the measuring signal from the outlet measuring system can provide some information on malfunctions. However, this measure alone is not sufficient to achieve a substantial improvement in the quality. The monitoring of the control signal in combination with an alarm or turning off the machine as was proposed in EP 340 756 hardly gives an advantage. By the time the staff carries out the check, the defective feed fibre structure has long been processed (corrected) by the draw frame, so that important information with respect to the error is no longer available. Because the supervision is set only to react to a short-term (possibly rare) "freak value", the segment of the feed fibre structure that is examined by the staff does not contain any information on the "event", so that again there is the risk of coming to an erroneous conclusion. The examination does not take place during the operation, but "off-line".

It is the object of the invention in a third aspect to further develop the autoleveller draw frame in such a way that the interactions that are decisive for its function are taken into account better than in the past.

The invention (in the third aspect) provides an autoleveller draw frame for fibre structures which comprises at least one draw zone, a drive system that can be controlled or regulated for determining the draft height in the mentioned draw zone, a programmable control unit for said drive system and at least one sensor for determining the fibre mass per unit of length that passes a measuring position. The draw frame is characterized in that a signal determining the draft is stored over a predefined period of time. From said stored values information is gained for adjusting the draw frame and/or evaluating the quality of the fed fibre structures. The above information comprises, for example, the CV-value of the fed fibre structure, the spectrogram of the fed fibre structure, and/or the length variation curve of the fed fibre structure. The control unit preferably comprises a digital signal processor, for example Motorola's 56001.

The signal that defines the draft can be the output signal of a sensor or the control signal for the drive system. A signal "that defines the draft" within the scope of this invention means that it has a direct or indirect influence on the draft, even if other signals also have such an influence.

The information can be gained by the control unit mentioned above and/or by a process control system, whereby in the latest case the stored values are preferable transmitted to the process control system via the control unit, e.g. in accordance with our Swiss patent application No. 1025/91-2 of Apr. 5, 1991 and U.S. application Ser. No. 07/927,307. The gaining of such information by the control unit itself is only possible in the event that said control unit comprises a digital signal processor or a device with similar or better processing power.

The sensor is preferably suited to trace shortwave deviations in the mass. In order to process such signals in accordance with digital technology it is necessary to digitize them, which is carried out by periodic scanning. In accordance with a preferred embodiment of the control unit the scanning rate is selected higher than 2000 Hz, preferably in the range of 2500 to 3500 Hz. Such a sigma can be processed in the processor in accordance With the fast. Fourier transformation method to allow the spectrum analysis.

The scanning rate of the control unit preferably remains constant. The speed of the passing material, however, is changeable. The control unit is also preferably provided with a sensor which reacts to the entrance speed of the material, so that the control unit (despite the constant scanning rate) is able to carry out a corrective action per incoming unit of length. The respective storage means are provided.

This preferred embodiment givers the advantage that the information can be gained from signals which are also used for controlling the corrective actions, thus increasing the uniformity of the information content of the various signals.

Based on the same or similar considerations, the operator support that is provided by the signals according to this invention is provided through the user interfaces (operator console or indicator boards) of the affected machines, as is described in the above-mentioned PCT patent application PCT/CH 91/0097 and U.S. patent application Ser. No. 07/798,813. In order to abridge the length of this description, the operator support shall not be treated herein as such. The statements of the PCT 91/0097 are, however, included in the present Specification by this reference.

Figure 11:
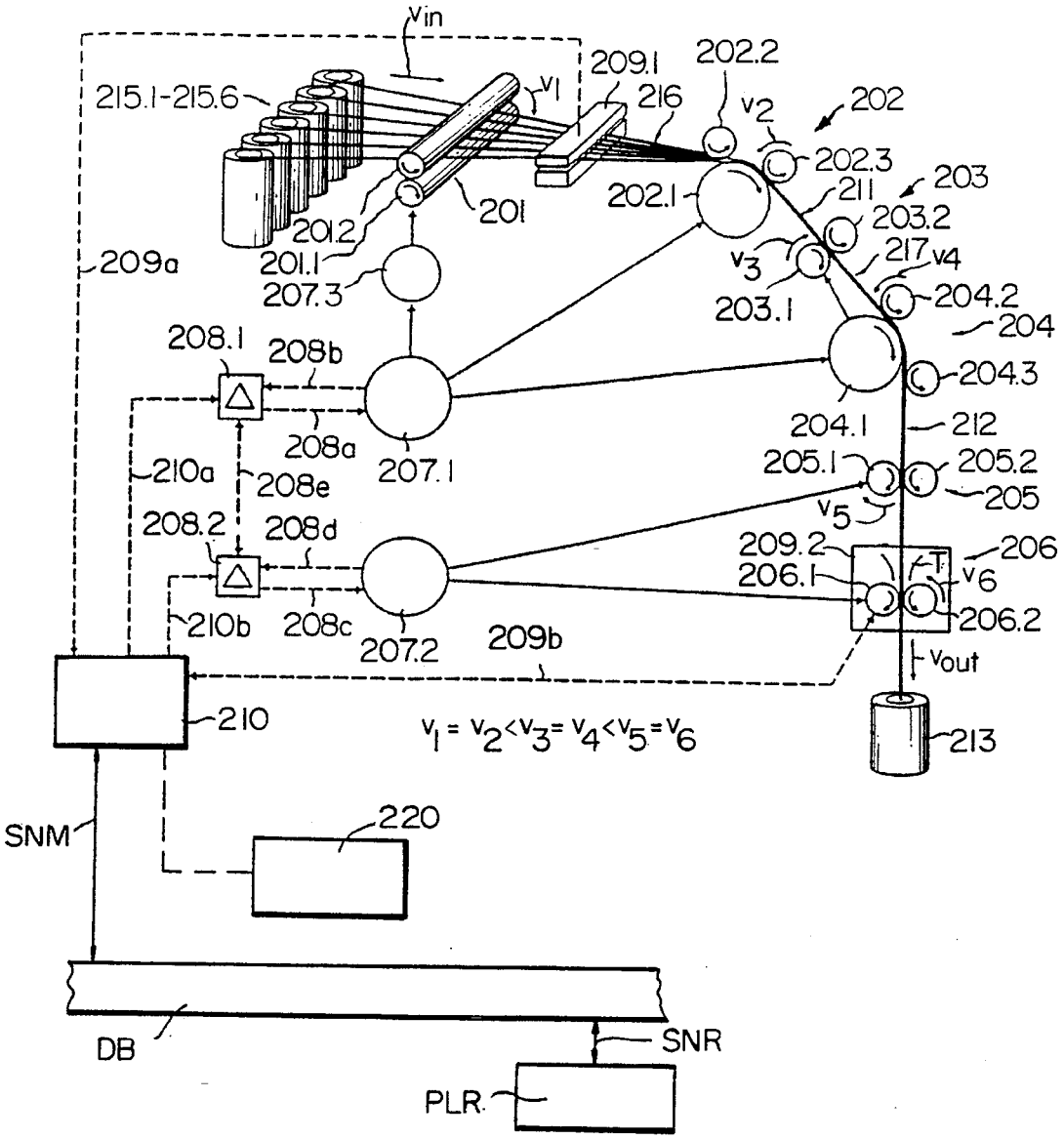
FIG. 11 shows a schematic view of preferred draw frame drive for an autoleveller draw frame in accordance with EP-A-0 411 379 and U.S. Pat. No. 5,248,925.

FIG. 11 shows a schematic display of an embodiment of the draw frame in accordance with our European patent application No. 0 411 379 and U.S. Pat. No. 5,248,925.

In the system in accordance with FIG. 11 several slivers 215.1–215-6, a total of six in the example, are combined to form a loose fleece and guided through several roller systems 201–206. Because the circumferential speed of the rollers increases in two steps in the conveying direction of the fibre material, said fibre material is predrawn (preliminary draft) through the first stage and further drawn through the second stage until it reaches the desired cross section (main draft).

The fleece leaving the draw frame is thinner than the fleece of the fed slivers 215.1–215.6 and respectively longer. As the drafting processes can be controlled depending on the cross section of the slivers fed, the slivers or the fleece is evened out during its passage through the draw frames, i.e. the cross section of the outgoing fleece is more even than the cross section of the fed fleece or the slivers. The present draw frame comprises a preliminary draw zone 211 and a main draw zone 212.

The slivers 215.1–215.6 are supplied to the draw frame through two systems of conveying rollers 201 and 202. A first system 201 consists, for example, of two rollers 201.1 and 201.2 between which the conveyance of the Slivers 215.1–215.6 that are fed and combined to form a loose fleece takes place. In the conveying direction of the slivers a roller system 202 follows which consists here of an active conveying roller 202.1 and two passive conveying rollers 202.2, 202.3. During the feed by the roller systems 201 and 202 the fed slivers 215.1–215.6 are brought together next to one another in order to form a fleece 216. The circumferential speeds $v_1$ and $v_2$ ($=v_{in}$) of all rollers of the two roller systems 201 and 202 of the feed are equivalent, so that the thickness of the fleece 216 is essentially equivalent to the thickness of the fed slivers 215.1–215.6.

After the two roller systems 201 and 202 of the feed a third system 203 of predrawing rollers 203.1 and 203.2 follows in the conveying direction of the fleece whereby the fleece is further conveyed by means of said third system. The circumferential speed $v_3$ of the predrawing rollers is higher than the speed of the conveying rollers $v_{1,2}$, so that the fleece 216 is drawn in the preliminary draw zone 211 between the conveying rollers 202 and the predrawing rollers 203, whereby its cross section is reduced. Simultaneously, a predrawn fleece 217 comes about from the loose fleece 216 of the fed slivers. Following the predrawing rollers 203 there is a further system 204 consisting of an active conveying roller 204.1 and two passive conveying rollers 204.2, 204.3 for further conveying the fleece. The circumferential speed $v_4$ of the conveying rollers 204 is the same as $v_3$ of the predrawing rollers 203.

Following the roller system 204 for the further conveyance in the conveying direction of the fleece 217 there is a fifth system 205 of main distorting rollers 205.1 and 205.2. The main distorting rollers have a higher surface speed $v_5$ than the previous conveying rollers, so that the predrawn fleece 217 between the conveying rollers 204 and the main distorting rollers 205 is drawn to the finally drawn fleece in the main draw zone 212, whereby the fleece is parallelized through a funnel T to a sliver.

The finally drawn silver is led away from the draw frame between a pair 206 of delivery rollers 206.1, 206.2 whose circumferential speed $v_6$ ($=v_{out}$) is equivalent to the speed of the previous main distorting rollers ($v_5$) and deposited, for example, in rotating cans 213.

The roller systems 201.2 and 204 are driven by a first servomotor 207.1, preferably through a toothed belt. The predrawing rollers 203 are mechanically coupled with the roller system 204, whereby the transmission can be adjustable or a scheduled value can be set. The gear (not shown in the Fig.) determines the ratio of the circumferential speeds of the feed rollers ($v_{in}$) and the circumferential speed $v_3$ of the predrawing rollers 203.1, 203.2, i.e. the predrafting ratio.

The roller systems 205 and 206 are driven by a servomotor 207.2. The feed rollers 201.1, 201.2 can also be driven by the first servomotor 207.1 or, optionally, by an independent motor 207.3. The two servomotors 207.1 and 207.2 each comprise its own controller 208.1 or 208.2. The control for each of them is carried out through a closed control loop **208.*a*, 208.*b* or 208.*c*, 208.*d*. In addition, the actual value of the one servomotor can be transmitted to the other servomotor in one or both directions through a control link 208.*e***, so that each of them can react pertinently to deviations of the other.

At the entrance to the draw frame the mass or a value proportional to the mass, e.g. the cross section of the fed slivers 215.1–215.6, is measured by a measuring instrument 209.1. At the exit from the draw frame the cross section of the outgoing Sliver 216 is measured by a measuring instrument 209.2.

A central processing unit 210 transmits an initial setting of the scheduled value for the first drive via **210.*a* to the first controller 208.1. During the drawing process the measured values of the two measuring instruments 209.1, 209.2 are continuously transmitted via the links 209.*a* and 209.*b* to the central processing unit. From these measured values and from the scheduled value for the cross section of the outgoing sliver 218 the scheduled value for the servomotor 208.2 is determined in the central processing unit or any other existing elements. This scheduled value is permanently transmitted to the second controller 208.2 via 210.*b*. By means of this control system (the "main control system") it is possible to compensate deviations in the cross section of the fed slivers 215.1–215.6** by the respective control of the main drafting process and to thus achieve the evening out of the sliver.

The draw frame shown in FIG. 1 is designed for a drafting device, but it can also be built into a combing machine, whereby the feed cans can be dropped in this case (as is shown in FIG. 7).

The lower part of FIG. 11 shows the adjustment of this system to the invention in this third aspect. In a first embodiment a memory 210 is allocated to the central control unit 220 of the machine, said memory being used to store the signals or certain signals of the draw frame control system for evaluation. If the processing speed of the central processor in the control unit 10 is high enough, it is possible to select such a high scanning rate that a spectrogram of the input signal (from sensor 209.1), the output signal (from sensor 209.2) and/or the control signals (signals transmitted to the motors 207.1 and/or 207.2) can be obtained.

A draw frame control unit in accordance with FIG. 11 is usually designed to carry out control actions in the material (changes in processing the material) not continuously, but after a certain interval. The duration of this interval is preferably selected not constant, but is adjusted to the feed speed in such a manner that the actions are each carried out at the end of a predefined length of fleece. In this respect it is possible to complement the shown arrangement in such way that the feed speed at, for example, the roller group 202 is determined and used for controlling the actions aimed at intervening in, the processing. In this event it is necessary to provide storage means (not shown) in the draw frame control unit to store the control signals and to activate them at the right time.

The evaluation of the values contained in the memory 220 does not take place depending on the feed speed, but in accordance with the time. When a spectrum analysis is made, the time functions are transformed to frequency functions by means of the fast Fourier transformation method. The time necessary for the transformation depends on the processing speed of the processor and the number of frequencies (or frequency ranges) that have to be examined separately. Preferably at least 1024 separate frequency ranges have to be examined for achieving a satisfactory analysis of a feed material.

Such an evaluation, however, requires considerable processing and storage capacities in the machine itself. This may often not be the case, so that the analysis has to be transferred to the process control computer PLC. For this purpose a databus DB may be provided and the control unit 10 can be provided with an interface SNM to said databus, whereby the computer PLR also comprises an interface SNR to the databus.

Neither the processing speed nor the storage capacity will usually limit the desired analysis in process control computer. In this case, however, the prerequisite for the analysis Consists of the fact that the process control computer must have access to the "raw data" of the respective sensors, as is shown, for example, in the above-mentioned Swiss patent applications No. 189/91 and 1025/91. The statements made in these two specifications are hereby included in the present description by this reference. Reference is also made to U.S. patent application Ser. No. 07/927,307.

The above-mentioned "raw data" are not to be understood as the actual output signals of the respective sensors. These signals may be prepared by the machine control unit (at least for the transmission to the process control computer). It is important that the essential information content is maintained for the intended analysis.

The Term Separator

The term "separator" has been used in some places in this description. This term is not common in the field of spinning engineering and will therefore briefly be outlined below.

The "separator" is the last position in a spinning line which carries out certain changes in the material to be processed (e.g. it changes the composition of the material, separates short fibres and/or changes the form of the structure). This position causes certain changes (if necessary), i.e. the position is not only a measuring position. The effect of a separator (its success) can be measured and the measured results are a measure for the (a defined) performance of the previous (i.e. those situated immediately beforehand) processing stages. The separator can therefore serve as a control station. Finally, insofar as the separator carries out the changes provided by it, it "erases" the respective information in the processed material, so that after the material has passed the separator there is no (more) information on the performance of the previous stages.

We claim:

1. An autoleveller draw frame for fibre structures, said draw frame being arranged after a plurality of successive textile machines in a fibre processing plant, for processing said fibre structures, said draw frame comprising:

at least one draw zone;

a controllable drive system for defining draft height of the fibre structures in said draw zone;

a programmable control unit for controlling the drive system;

at least one sensor for determining mass per unit of length of the fibre structures passing a measuring position;

means for storing a signal defining the drafted fibre structures for a predetermined period of time, said signal being representative of information for affecting a quality parameter of the fibre structures; said means for storing said signal including a memory unit for storing said signal; and a process control computer, said process control computer also being utilized for recalling said signal stored in said memory unit for use in controlling a quality parameter of the fibre structures in said plurality of successive textile machines of said fibre processing plant.

2. An autoleveller draw frame in accordance with claim 1, wherein:

said signal is representative of information for adjusting the draw frame.

3. An autoleveller draw frame in accordance with claim 1, wherein:

said signal is representative of information for determining a value of the quality parameter of the fibre structures.

4. An autoleveller draw frame in accordance with claim 1, wherein:

said signal is representative of information for determining a value of the quality parameter of the fibre structures and is representative of information for adjusting the draw frame.

5. A method of using the autoleveller draw frame in accordance with claim 1, said method comprising:

obtaining a signal defining the drafted fibre structures and storing said signal for a predeterminate period of time.

6. A method of using the autoleveller draw frame in accordance with claim 5, wherein:

said obtaining a signal and storing said signal comprises obtaining a control signal of said programmable control unit and storing said control signal for evaluation.

7. A method of using the autoleveller draw frame in accordance with claim 5, further comprising:

adjusting the draw frame in response to said signal after elapse of said predeterminate period of time.

* * * * *